United States Patent [19]

Lipsker

[11] Patent Number: 4,547,106

[45] Date of Patent: Oct. 15, 1985

[54] GROUND ANCHORS

[76] Inventor: Yitshaq Lipsker, 24 Trumpeldor St., Ramat Hasharon, Israel

[21] Appl. No.: 475,503

[22] Filed: Mar. 15, 1983

[51] Int. Cl.[4] ..... E21D 20/00

[52] U.S. Cl. ..... 405/259; 405/244; 405/237; 405/262; 52/160

[58] Field of Search ..... 405/259, 236-242, 405/244, 272; 166/187; 52/160, 161; 175/19, 274, 216, 325, 391, 394

[56] References Cited

U.S. PATENT DOCUMENTS

| | | | |
|---|---|---|---|
| 1,807,488 | 5/1931 | Michalicek | 52/161 X |
| 1,970,063 | 8/1934 | Steinman | 175/391 X |
| 2,779,240 | 1/1957 | Gaydos | 52/160 X |
| 2,910,274 | 10/1959 | Scott | 175/316 X |
| 3,039,533 | 6/1962 | Lacey | 166/187 X |
| 3,209,546 | 10/1965 | Lawton | 405/238 |
| 3,343,614 | 9/1967 | Parisien | 175/19 |
| 3,438,212 | 4/1969 | Turzillo | 405/236 X |
| 3,864,923 | 2/1975 | Turzillo | 405/238 |
| 4,160,613 | 7/1979 | Stanwick | 405/259 X |
| 4,247,222 | 1/1981 | Schosek | 405/272 X |
| 4,411,557 | 10/1983 | Booth | 405/238 |

FOREIGN PATENT DOCUMENTS

| | | | |
|---|---|---|---|
| 1238773 | 6/1960 | France | 405/237 |
| 1102682 | 2/1968 | United Kingdom | 405/237 |

*Primary Examiner*—Dennis L. Taylor

*Attorney, Agent, or Firm*—Toren, McGeady, Stanger, Goldberg & Kiel

[57] ABSTRACT

A ground anchor is composed of a number of components and is firmly held in position in the ground by its components being moved apart and firmly urged onto the wall of the cavity in which the ground anchor is positioned.

7 Claims, 11 Drawing Figures

GROUND ANCHORS

BACKGROUND AND FIELD OF INVENTION

The present invention relates to ground anchors as are conventionally employed for such purposes as e.g., retaining of embankments or slopes, for holding rock faces, for tying retaining wharf faces and the like more.

Generally the anchor which is inserted in a bore in the ground, is firmly attached to the lowermost part of the bore wall by means of poured-in cement mixture or certain plastics or chemicals. From that body—which is thus firmly held at the bottom of the bore—there extends a shaft or a cable upwardly to the surface which shaft or cable is firmly connected with a surface element which bears against the respective surface the uppermost stratum of which is to be retained or fixedly and firmly held.

There have been known also rock anchors which are commonly referred to as "dry anchors" and which are held in the rock by friction, being operated on the "rawl plug" principle.

It is also known to place a ground anchor in the soil by making a bore of appropriate depth, widening the bore in its lower regions and inserting a shaft into the bore which shaft extends down to the said widened portion and then pouring a concrete mix or plastics into the bore so as to fill the said lowermost, widened portions and thus create a ground body which firmly adheres to the shaft and is securely held in the soil, since the widened portions on the cast withstand movement—such as e.g. upward pull—of the ground body.

SHORT SUMMARY OF DISCLOSURE

The present invention—in its widest aspects provides a ground anchor which is composed of a number of components and is held in the respective bore by being expanded, i.e. by its components being moved from each other so that these components are firmly urged onto the wall of the respective bore. The element which is held in the ground after having been expanded will be referred to hereinafter as "ground element".

In a practical embodiment of the invention, a ground anchor is placed in the soil by making a bore of appropriate depth, widening the bore in its lower regions, creating a cavity of suitable shape and inserting a shaft into the bore which shaft extends down to the cavity and then pouring a concrete mix, plastics or solidifying chemicals into the bore so as to fill the said lowermost, widened portions and thus create a ground body which firmly adheres to the shaft and is securely held in the soil, since the widened portions on the cast withstand movement—such as e.g. upward pull—of the ground body.

In yet another practical embodiment the ground anchor may be formed by a crosswise expandable structure which comprises a shaft and depending therefrom—being hingedly connected thereto—a series of interconnected four-bar linkages, the size of each linkage in the row being greater or equal to that of the preceding one, all linkages being enclosed within a space of at least two pressure plates which are laterally movable relative to the shaft and extend within the range of the expanding four-bar linkages, means being provided for expanding the linkages crosswise relative to the shaft.

SHORT DESCRIPTION OF DRAWINGS

The different embodiments of the invention will now be described in detail with reference to the annexed drawings.

In the drawings there is shown schematically in

FIG. 1, the new ground anchor in a longitudinal section, in the mechanically operated embodiment.

FIGS. 5, 6 and 7 illustrate by way of schematical, axial section view of bores, with ground anchors inserted, while

DETAILED DESCRIPTION OF PREFERRED EMBODIMENTS

Figure 1:
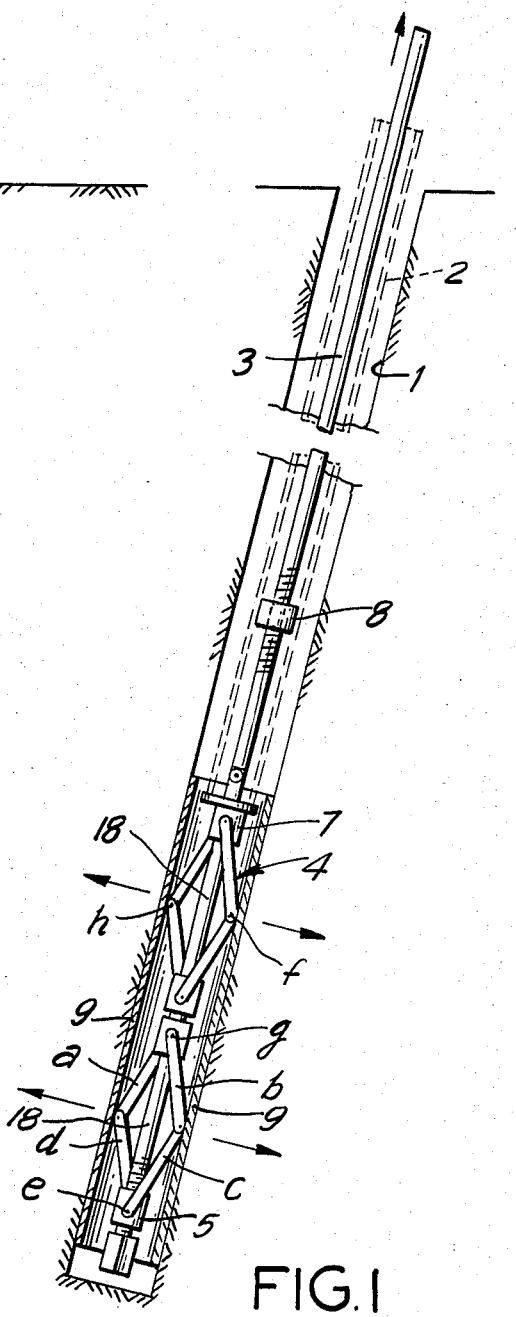
Figure 2:
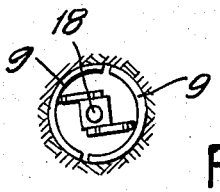
FIG. 2 is a cross-sectional view of the same embodiment.

Turning to FIGS. 1 and 2, a bore is made in the ground at the site which requires application of a ground anchor for whatever reason. The bore is indicated by the numeral 1. This bore may extend strictly vertically whenever a top stratum of the ground is to be secured, or it may extend obliquely, as shown in the drawing—say for holding an embankment—but it may also extend horizontally—say for holding the wall of an excavation, and it can be used also vertically in an upward direction, say in securing the roof of a tunnel.

Into the bore 1 may be placed (but need not always be placed) a pipe 2, in which extends the shaft 3, connecting the ground element 4 with a top element (not shown). The ground element in the embodiment of FIG. 1 is a four-bar linkage comprising bars a, b, c, d which are pivotally interconnected at four points e, f, g, h. Point e, is at the same time connected with a solid member 5. The point a, is in the same way connected to a like member 7. Two semi circular shells 9 are positioned to enclose the linkage a, b, c, d.

As can be seen in FIG. 1, there are provided two four-bar linkages which, however, is one possibility of many. There may be, in certain cases, one such linkage or even more than two.

Linkages of this kind are conventional devices used in many applications, e.g. a small automobile lifting jacks, and need no further description. The opposite points f and h of the linkage apply themselves to the inside of the two shells 9. In the pipe 2 is fixed a nut member 8 into which extends a screw-threaded portion of shaft 3. Between the apices g and e of the four-bar linkages extend rods 18 which, functionally may be considered as extensions of shaft 3.

It can easily be understood that by turning the shaft, at the top of the bore (as indicated by the numeral 1), a downward urge acts on member 7 and on point a of the uppermost linkage, the consequence being that the linkage (or linkages) spread, and at points f and h exert initial outward pressure onto shells 9 so that these are pressed onto the wall of the bore and the ground element becomes held in the bore.

Subsequent to the move of shells 9 towards the wall of the bore and these shells being initially pressed to the wall, a pull-out force may be applied to the shaft 3 against pipe 2 (e.g. by means of an hydraulic jack or winch). As a consequence, rods 18 exert pull on apices e of the linkages, resulting in further spread of the latter, further resulting in increased outward pressure. The greater the force of pull, the larger becomes this pressure.

At the top element, say a holding plate is affixed to the shaft 3 in a conventional way.

Figure 3:
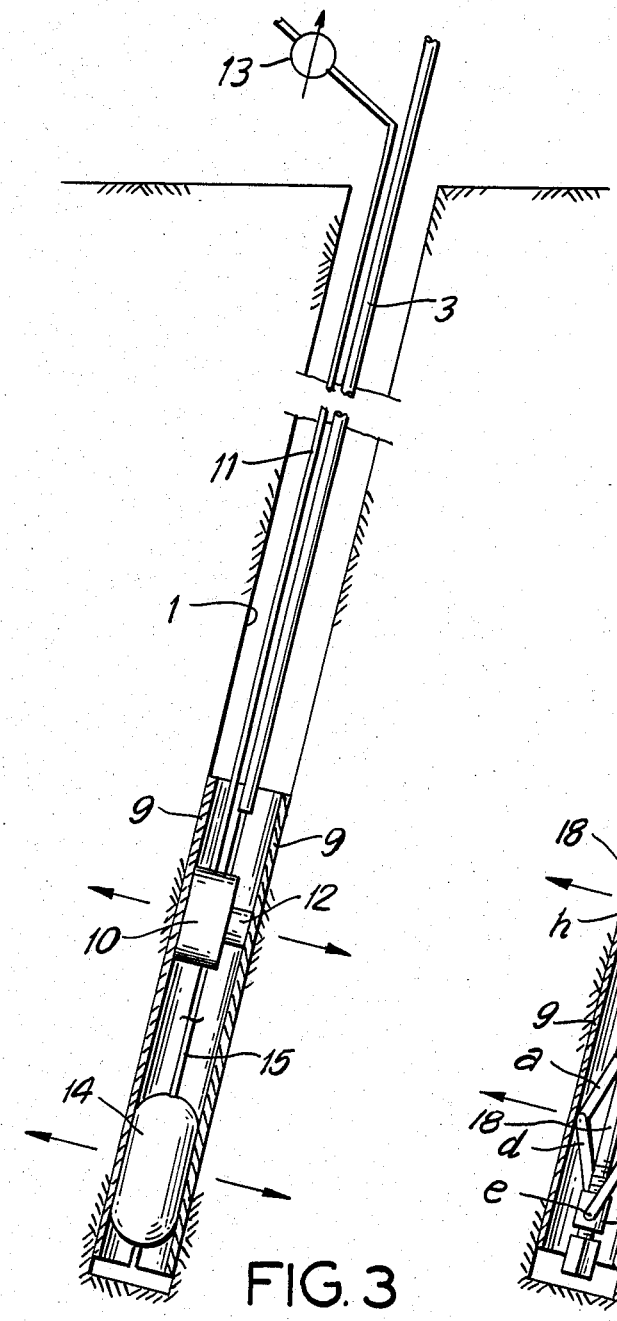
FIG. 3 shows in longitudinal section, both the embodiments which are hydraulically and pneumatically operated.
Figure 4:
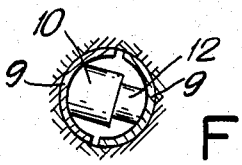
FIG. 4 is a cross-sectional view of the pneumatically or hydraulically operated embodiment.

Turning now to FIGS. 3 and 4, where two operational ways are illustrated, the parts identical with those of the arrangement of FIG. 1 are indicated by the same numerals. Into the bore 1 extends the shaft 3 or a cable, which is fixedly connected to the shells 9. Within the circular space defined by the two shells is positioned a hydraulic jack 10 to which pressure fluid is fed by a conduit 11. The outward movement of the piston 12 of the jack causes the two shells 9 to move apart and become firmly wedged in the bore 1. The pressure applied to the jack can be read off an instrument 13 at top level.

FIG. 3, in its lowermost portion shows an alternative to the hydraulically operated arrangement. Here a balloon 14 is positioned within the space between the shells 9. This balloon is inflated via a conduit 15, again exerting outward pressure onto the shells 9, the effect being the same as described in connection with the alternative arrangements.

In the hydraulic and pneumatically operated embodiments, the expanding devices can be removed after full outward urge is attained, and locking devices may be inserted holding the shells 9 in expanded position.

It will be seen that the new ground anchor cannot only be quickly put in position of action, but can also be withdrawn when no longer needed, to be immediately employed at another site.

However, it would be within the scope of the invention, to use the anchor in the way described and then pour onto it concrete or a plastic or chemical mass, and so make it permanent.

Once a suitable mass has been poured, the device just described could also serve as a micropile, i.e. it could be used as a bearing element and part of a foundation system that could resist downwardly acting forces, as well as pull out forces.

It should be remarked that it would be within the scope of the invention to make certain changes in the means effecting the expansion of the ground element. So, e.g. instead of the linkages shown in FIG. 1, different—and possibly also conventional—means could be employed.

Figure 5:
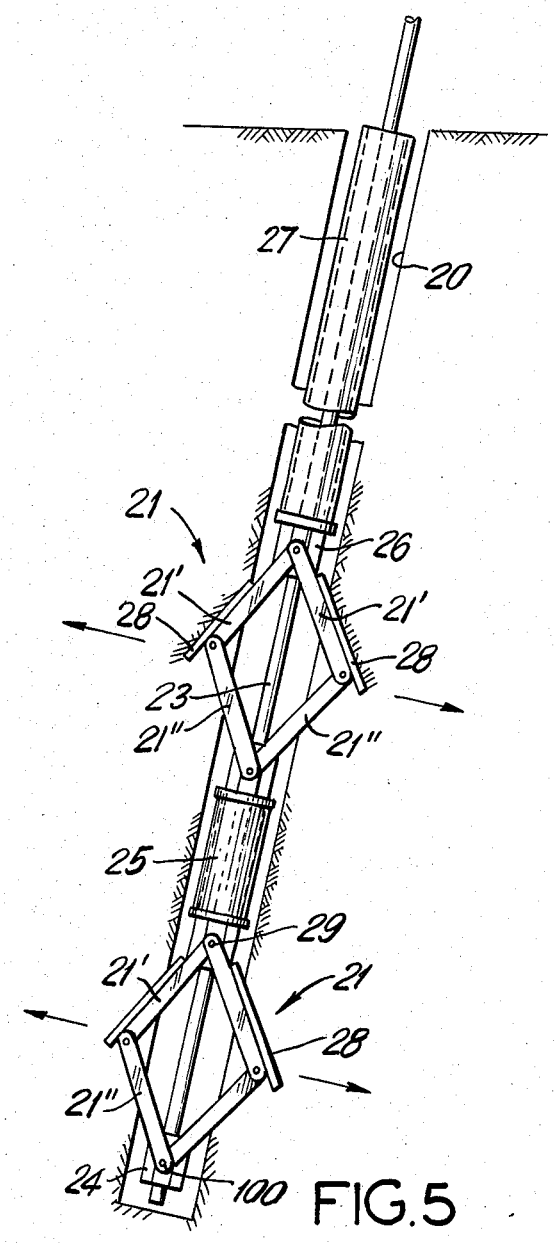

Turning now to FIG. 5, there is shown a bore 20 made in the ground in whatever conventional way. Into the bore 20 is introduced a device which comprises two four bar linkages designated as wholes by the numeral 21. Obviously—on introduction of the device —the linkages 21 are fully folded, i.e. the four bars extend substantially along and close to a central shaft 23.

Each of the linkages 21 has (in the portion shown in FIG. 5) two "upper bars" 21' and two lower ones 21''. The upper bars are hingedly connected with the lower ones. The lowermost one of the linkage 21 has its lower two bars 21'' affixed to a body 24 which is fixed on shaft 23. Thus the lowermost linkage 21 is fixedly connected with shaft 23. A tubular body 25, freely sliding on shaft 23, is hingedly connected at 29 with the upper two bars of the lower linkage 21. The same body 25 is hingedly connected to the lower two bars of the upper linkage 21. The two upper bars 21' of the upper linkage 21 are hingedly attached to an ear 26 which extends from the closed end of a length 27 of pipe through which the shaft 23 extends. This pipe extends up to the top of the bore and ensures free movement of shaft 23.

Figure 6:
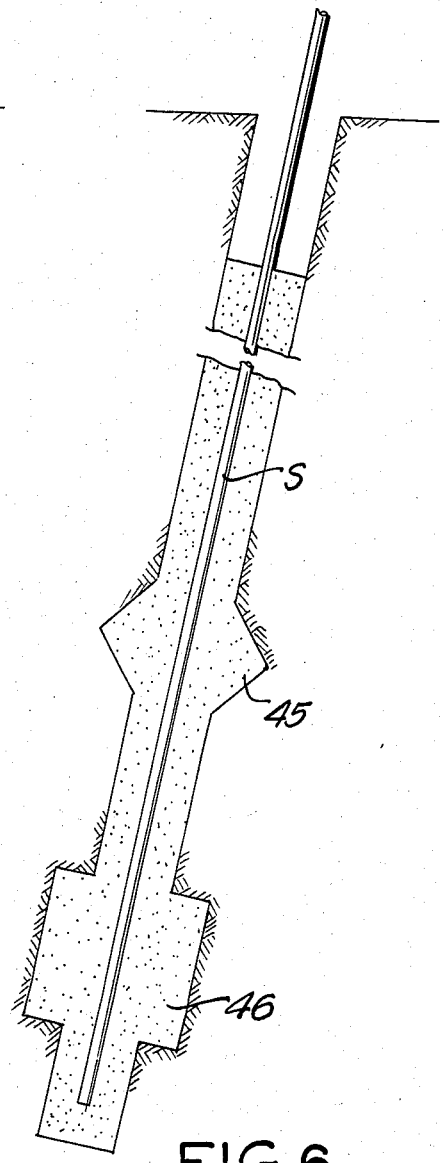
Figure 5A:
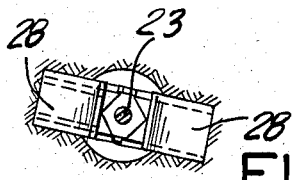
FIGS. 5*a*, 6*a* and 7*a* are schematical, horizontal sections—also schematical—of the said three embodiments.
Figure 6A:
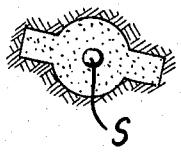

To the upper two bars 21' of the linkage 23 are attached plates 28. As has already been stated, the device shown in FIG. 5 is supposed to have been introduced into bore 20 with all linkages 21 fully folded. Now, in order to attain the position of the device which would result to what is shown in FIG. 6, an abutment is placed at the top of the bore and against pipe 27 (not shown) and pull is exerted on shaft 23. Since the lowermost end of the shaft is affixed to the lowermost point of linkage 21, this point—indicated by the numeral 100 is moved upwardly, causing the linkage 21 to spread. First the lowermost linkage widens, to be followed by the one (or ones) above it. The movement may be continued until all plates 28 are in a position shown in FIG. 5, i.e. the linkages define a rhomboidal shape, or the movement may be continued until all plates 28 are in horizontal planes.

As a result of this movement of the linkage bars, the bore is widened at those places where plates 28 had been forced into the wall of the bore.

Where soil conditions permit, i.e. there being no danger of caving in of the bore, the device can be brought back to initial position, i.e. all linkage bars extending along shaft 23, so that the device may be withdrawn. Now shaft S may be placed into the bore and concrete, plastics or chemicals may be poured into it. In those cases where the linkages had been spread to the position shown in FIG. 5 the widened portion of the bore will have approximately the shape indicated by 45 in FIG. 6. In the case of plates 28 having been moved strictly horizontally (e.g. being attached laterally to the linkages) the widened portion will be as shown at 46 in FIG. 6.

In all cases the poured in mass adheres firmly to shaft S and forms the ground element of the ground anchor. This latter is held positively at its portion 45 or 46 (as the case may be) and not solely by frictions as would be the case without the widening of the bore. Alternatively, by locking shaft 23 relative to pipe 27 no hardening mass needs be poured, a re-usable ground body having thus been created.

Figure 7:
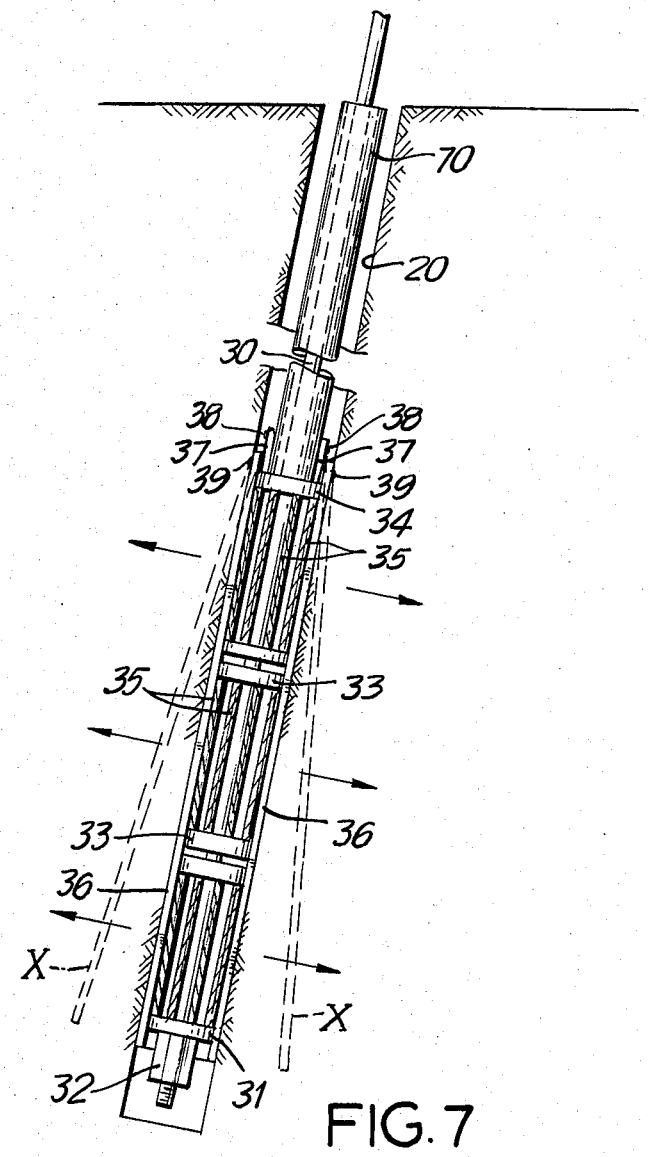
Figure 7A:
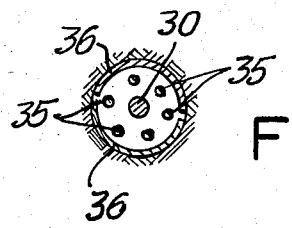

Turning now to FIGS. 7 and *7a:* There are available at construction sites large quantities of short pieces of steel cable which are considered waste and sometimes even constitute a nuisance since they cannot be disposed by burning them. This waste can usefully be employed in practising the invention.

As shown in FIG. 7, there is produced a bore 20, into which is inserted a device which comprises a shaft 30 extending within a length 70 of pipe. To the lowermost end of the shaft 30 is fixedly attached a disc 31, e.g. being held in place by a nut 32 screwed on to screw threaded end of shaft 30. Similar discs 33 are provided freely slidable on shaft 30. An uppermost disc 34 is fixedly connected with pipe 70 and is immovable. Between the discs 31, 33, 34 extend lengths of the cable, indicated by the numeral 35. These lengths of cable are fixedly attached to the discs between which they extend. There are suspended from shaft 30 two shells 36 of semi circular profile. They are hung from two connecting rods 37 which latter are hingedly connected at 38 to the pipe 70 and at 39 with the said shells 36.

If pull is exerted on shaft 30 against pipe 70, disc 31 is pulled up and since disc 34 cannot move, all lengths of cable bulge outwardly from the centre of the bore and press the shells into the soil forming the wall of the bore. Due to the hinged connection of rods 37 the outward movement of the shells increase in downward direction, the shells assuming the position symbolized by the broken lines X, i.e. the bore widens to create a cone shaped cavity. This cavity where filled with a hardened mass causes a practically immovable ground body to become created.

Alternatively, by locking shaft 30 relative to pipe 70 no hardening mass need be poured, a re-usable ground body having been created.

Figure 8:
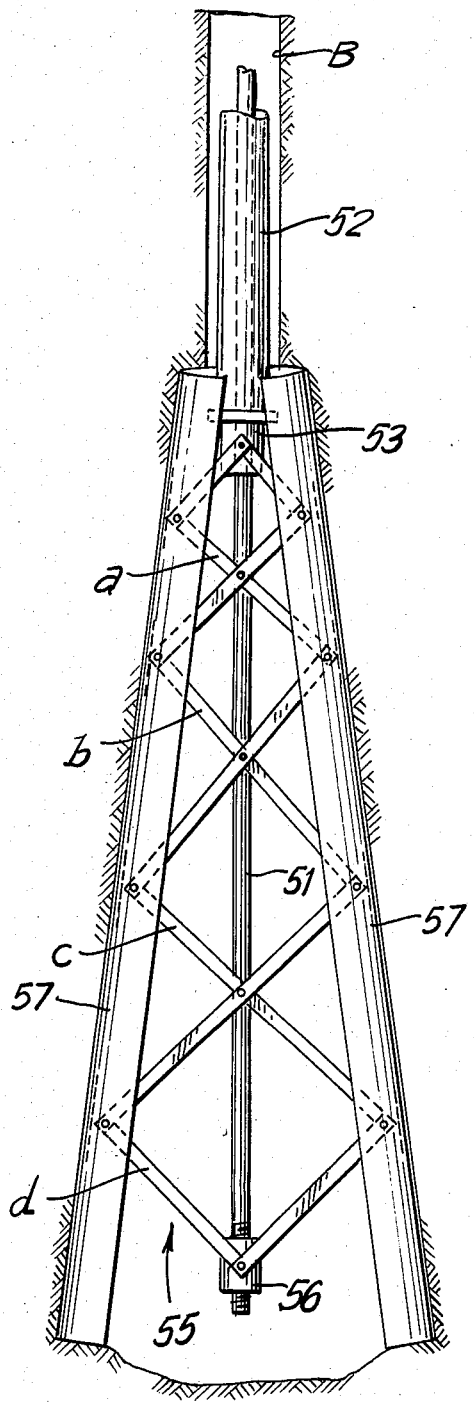
FIG. 8 illustrates yet another practical embodiment.

According to FIG. 8 shaft 51 extends within a safeguarding tube 52. The shaft 51 may extend upto the surface or may be attached to a cable, still within the bore B.

The shaft 51 passes through a body 53 to which is pivotally affixed the first one of a series of four bar linkages. This assembly of linkages is designated as a whole by the numeral 55. The individual linkages from top to bottom are indicated by letters a, b, c, d. As can be seen linkage a is smaller than b which is smaller than c and the latter is smaller than d. Two bars of linkage a are extended to form part of b, two bars of b extend into c, and two bars of c form also part of d.

The shaft 51 has screw threaded lower end onto which screws a nut 56.

The lowermost joint of linkage d is pivotally connected to the nut 56.

By turning the shaft 51 (from the surface) the linkage d will become wider or narrower across.

To the protecting pipe 2 are swingingly affixed two curved pressure plates 57.

The new ground body is operated as follows:

The shaft is turned or pulled against pipe 52 thereby increasing the crosswise dimensions of linkage d. All linkages being interconnected, all have their diameter increased, thereby exerting lateral pressure on plates 57 which assume a position in which they are farther away at bottom than at top—from the centre of the ground body i.e. the shaft 1. As a result the bore B—within the range of plates 57 assumes the shape of a cone and thus ensures increased holding and anchoring capacity. The device may be left in the ground as a tapered re-usable anchor or it can be withdrawn leaving a tapered cavity in which shaft 51 is placed and into which concrete, plastics or solidifying chemicals are poured.

I claim:

1. A ground element of a ground anchor characterised by being formed by a crosswise expandable structure which comprises an axially extending shaft having a first end and a second end a series of interconnected four bar linkages extending in the axial direction of and hingedly connected to said shaft, the size of each linkage in the series being greater than that of the preceding one extending in the direction from the first end toward the second end with the largest linkage located closer to the first end, two bars of each said linkage being common to it and to the adjacent said linkage, at least two pressure plates extending generally in the axial direction of said shaft and being spaced laterally apart and forming a space therebetween, all said linkages being located within the space between said at least two pressure plates which are laterally movable relative to the shaft and extend within the range of the expanding four bar linkages, means provided for expanding the linkages crosswise relative to the shaft.

2. A ground anchor comprising a ground element as claimed in claim 1, characterized therein by mechanical means provided for expanding said linkages.

3. A ground anchor comprising a ground element as claimed in claim 1 characterized therein by pneumatic means provided for expanding said linkages.

4. A ground anchor as claimed in claims 2, 3 or 1, characterized therein that said pressure plates are constituted by two semi circular shells.

5. A ground anchor as claimed in claim 3 characterised thereby that the said pneumatic means are constituted by an inflatable balloon.

6. A ground anchor as claimed in claim 1, wherein said means for expanding the linkages comprises hydraulic means.

7. A ground anchor as claimed in claim 6 characterised therein that said hydraulic means are constituted by an hydraulic jack.

* * * * *